United States Patent [19]

Hickman et al.

[11] Patent Number: 4,541,541

[45] Date of Patent: Sep. 17, 1985

[54] TAMPER-RESISTANT CLOSURE FOR DISPENSERS

[75] Inventors: John R. Hickman, Talmadge; Nicholas J. Kriska, Uniontown; Jeffrey H. Brechtelsbauer, Stow; Bruno A. Mediate, Maple Heights, all of Ohio; Jordan I. Rotheiser, Highland Park, Ill.

[73] Assignee: Weatherchem Corporation, Twinsburg, Ohio

[21] Appl. No.: 659,234

[22] Filed: Oct. 9, 1984

[51] Int. Cl.[4] ..... B65D 51/18

[52] U.S. Cl. ..... 220/253; 220/258; 220/266; 222/153; 222/480; 222/516

[58] Field of Search ..... 220/253, 256, 257, 258, 220/266; 222/153, 480, 516, 548

[56] References Cited

U.S. PATENT DOCUMENTS

| | | | |
|---|---|---|---|
| 3,486,665 | 12/1969 | La Croce | 220/253 |
| 4,274,563 | 6/1981 | Otterson | 222/480 |
| 4,308,979 | 1/1982 | Otterson | 220/253 |
| 4,500,016 | 2/1985 | Funfstuck | 222/153 |

*Primary Examiner*—George T. Hall

*Attorney, Agent, or Firm*—Pearne, Gordon, Sessions, McCoy, Granger & Tilberry

[57] ABSTRACT

A tamperproof dispenser end closure includes a base and a rotor pivotally connected to the base by a hub. The base and rotor have webs provided with means defining respective dispensing apertures. The base and rotor are retained in a close superposed relationship to each other by the hub. Frangible means are provided which tear or break when an attempt is made to separate the base from the rotor so that the base and rotor cannot be pivotally connected again by the hub.

18 Claims, 6 Drawing Figures

TAMPER-RESISTANT CLOSURE FOR DISPENSERS

BACKGROUND OF THE INVENTION

This invention relates generally to end closures for dispensers, cans, containers, and the like. More particularly, the invention relates to tamper-resistant closures having rotary tops.

PRIOR ART

Many different types of containers and closures have been developed to meet consumer needs for dispensing foods, condiments, chemicals, household cleansers, and similar products. One of the most popular closure designs from an aesthetic as well as convenience point of view is the rotary top closure having multiple openings commonly used for dispensing granulated foods and flavorings.

The rotary top design typically includes two major elements, namely, the rotor and the base. The base is attached to the end of a cylindrical or rectangular container by a suitable adhesive, friction fit, or like means. The base includes a web portion having one or more openings or windows therein through which the contents may be dispensed. Typically, to preserve freshness and to provide an indication of product integrity to the consumer, the dispensing opening is initially covered by a removable portion or tab of the web. The consumer can then push out the tab portion, thereby opening the container.

The rotor also includes a web portion having one or more openings therein which are alignable with the base openings when the rotor is manually rotated by light finger pressure. The rotor may be pivotally attached to the base by a hub or stem which extends through a central opening in the base and forms a snap fit or friction fit between the base web and the hub.

While a removable tab provides some indication that the package has not been opened in the normal manner, there is no readily perceivable indication to the consumer that the base and rotor have been pulled apart or separated. When the rotor is pulled off the base, the contents may be adulterated through the hub opening in the base web and the rotor reinstalled with no indication that the container has been tampered with.

SUMMARY OF THE INVENTION

The present invention provides a new and improved end closure for containers and like articles which is both tamper-resistant and convenient to use.

According to one aspect of the invention, a rotatable container is provided which is rendered unusable in its normal operating manner when tampered with so as to contaminate or alter the contents.

According to another aspect of the invention, an end closure is disclosed which immediately provides visual or structural indicia to the end user or consumer that the closure has been tampered with or the contents adulterated.

According to a third aspect of the invention, an end closure is provided with one or more frangible sections which tear or separate when an attempt is made to pull or otherwise separate the base from the rotor.

These and other aspects and advantages of the invention will be more fully understood from the following description in view of the acompanying drawings.

DESCRIPTION OF THE PREFERRED EMBODIMENTS

Figure 1:
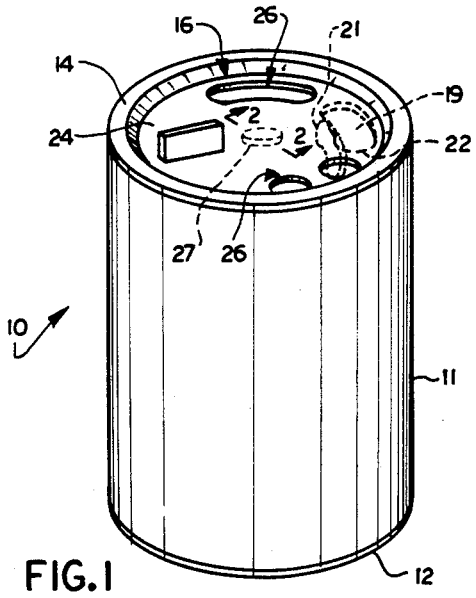
FIG. 1 is a perspective view of a container having a rotatable end closure according to the present invention.

A container such as for food products, condiments and similar granulated products is generally indicated by the numeral 10 in FIG. 1. Such container is generally cylindrical in shape, having a wall portion 11, bottom end cap 12, and a rotatable top end closure, generally indicated by the numeral 13, used for dispensing the contents of container 10. Typically, the disclosed end closures are made of injection-molded plastic parts with a suitable thermoplastic material such as styrene or polyethylene. Light gauge deformable metals may also be used.

Closure 13 includes a base 14 and a rotor 16 pivotally attached to an outer side of the base. Base 14 is provided with an annular skirt (not shown) which engages the inner or outer surface of wall portion 11 at an outlet end. The skirt is friction-fitted or otherwise secured in a sealed manner with the inner surface to the wall 11. Thus, base 14 is held in sealing engagement with container 10 to prevent leakage, spoilage or contamination of the contents.

Figure 3:
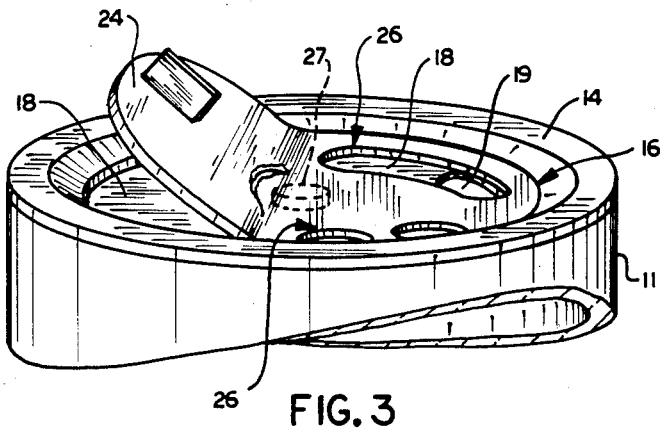
FIG. 3 is a perspective view of the end closure shown in FIG. 1 when an attempt is made to separate the rotor from the base.
Figure 2:
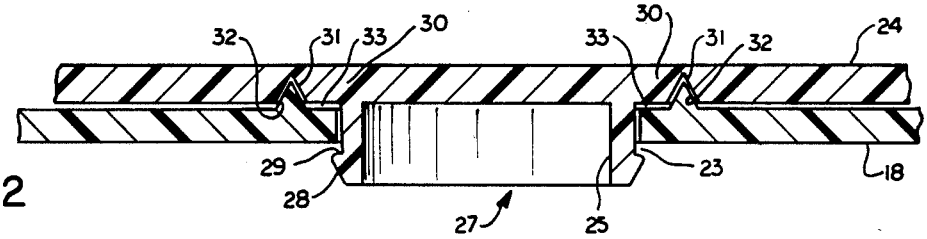
FIG. 2 is a cross-section taken substantially along line 2—2 of FIG. 1.

Referring to FIGS. 1, 2 and 3, base 14 includes a thin web membrane 18 having a generally uniform thickness. Web 18 extends over the dispensing end of wall 11. Web 18 typically is provided with one or more dispensing means 19 which define apertures through which the contents can be dispensed.

Dispensing means 19 are formed in web 18 by providing one or more pushout tabs 21 each defined by a perimeter 22 having a substantially reduced web thickness. Each tab 21 is easily breakable by a manual force exerted thereon in a direction toward the interior of the container 10, thereby forming an aperture in web 18 (as shown in FIG. 1). The sizes and shapes of the apertures are a matter of design choice to one skilled in the art, depending on the particular dispensing arrangement desired, as by shaking, pouring, or with a spoonlike utensil.

Web 18 is also provided with a round opening 23 which may be conveniently located centrally of web 18. The opening 23 receives a part of the rotor 16 for purposes of assembling these elements together.

Rotor 16 is preferably a disc-like member having a web portion 124 provided with one or more openings 26 therein which are alignable with tab 21 or the aperture 19 formed therefrom by pivotal movement of rotor 16. Rotor 16 is pivotally attached to base 14 by a circular hub or stem 27 which in the illustrated case is coaxial with the center of the rotor. As best shown in FIGS. 2 and 3, rotor 16 and base 14 are held in close, parallel, superposed relation. Rotation of rotor 16 about the longitudinal axis of stem 27 allows either the opening of dispensing means 19 by alignment of rotor openings 26 with the base apertures, or closing by covering the base apertures with a portion of the rotor web 24, as is well known in the art.

Stem 27 is integrally formed with rotor web 24 and includes a longitudinal side wall or web portion 25 which extends through opening 23 with a slight radial clearance when rotor 16 and base 14 are in their assembled superposed configuration. An annular stem flange 28 is formed on the free end of stem 27 and provides a shoulder 29 which retainably engages the underside of base web 18 about the periphery of opening 23. Flange 28 is made with a slightly larger diameter than opening 23 such that a snap fit arrangement between the rotor 26 and base 14 is achieved while still allowing rotor 16 to pivot about the axis of stem 27. Thus, stem 27 provides both a means for rotor 16 to pivot with respect to base 14 about the axis of stem 27 and a means to retain the rotor and base in a close, superposed relationship.

When the base is made of metal or plastic material harder than that of the rotor, in lieu of using an undercut shoulder on stem 27, opening 23 may be undersized with respect to the outer diameter of stem 27. When the stem 27 is pressed into the opening 23, the base material at the perimeter of the opening will bite into and retain the stem.

While tabs 21 provide some assurance to the end user that the contents have not been tampered with, it may be possible with the aforementioned conventional design to pull the assembled rotor apart from the base, thereby gaining access to the contents through opening 23. After the contents have been adulterated, the rotor could be reinstalled onto the base and the unit would appear and operate as normal.

According to the concepts of the present invention, as best shown in FIG. 2, a frangible area of reduced web thickness, preferably a concentric annular V-groove 31, is provided in rotor web 24 about hub 27.

Referring to FIG. 3, annular V-groove 31 is formed in rotor web 124 and when an attempt is made to pull the rotor off or away from the base, the V-groove thicknes is such that web 24 tears along weakened groove 31 because the heavier and stronger stem undercut 28 retains stem 27 in opening 23. Thus, when rotor 16 is forcibly separated from base 14, stem 27 and a portion 30 of web 24 is retained on the base. As a result, after such tearing has occurred, the rotor and base cannot be reassembled to operate in the normal manner described hereinbefore because one or both of webs 18 and 24 are no longer intact. The consumer has an immediate visual and functional indication that the end closure has been tampered with. An important criterion is that the retaining strength of the stem 27 be greater than the strength of the frangible V-groove 31.

An annular V-shaped bead 32 is provided on the base web 18. Bead 32 extends into V-groove 31 and prevents insertion of a substantially flat object, e.g., a knife edge or screwdriver blade, intermediate rotor 16 and base 14 near stem 27 and interior of the frangible V-groove as at 33, which could otherwise be done to pry the base and rotor apart without tearing the webs.

The actual location, shape, and thickness of the frangible grooves will vary depending on the particular configuration of end closure 13, and such variations are within the scope of the present invention, the illustrations described herein being for exemplary purposes only.

Figure 4:
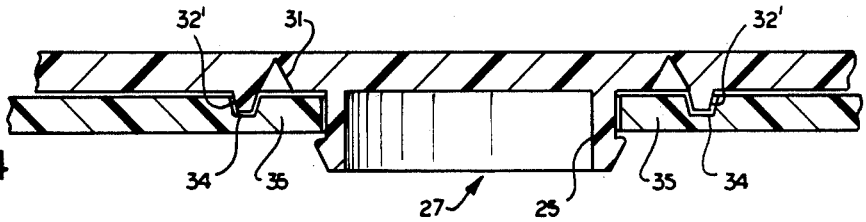
FIG. 4 is a cross-sectional view of another embodiment of the present invention.

It will be noted that the V-grooves described hereinbefore may be formed in either the upper or the lower surfaces of webs 18 or 24. As shown in FIG. 4, frangible groove 31 is formed in the lower surface of rotor web 24, and an annular channel 34 is formed in the upper surface of base web 18 about groove 31. Bead 32' is formed on the lower surface of rotor web 24 and extends into channel 34, thereby preventing insertion of a flat object as before described. Of course, channel 34 could also be adapted to act as the frangible groove so that a portion 35 of the base web 28 would be torn away.

Figure 5:
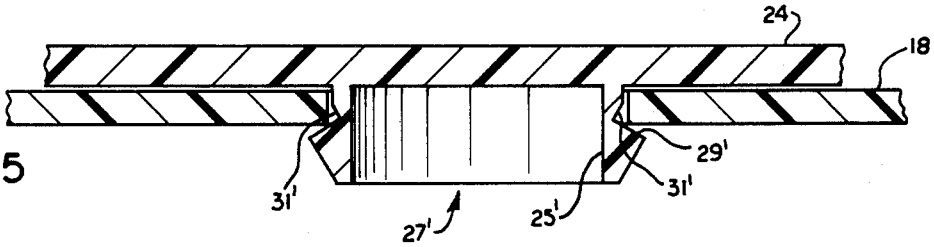
FIG. 5 is a cross-sectional view of a third embodiment of the present invention.

Another embodiment of the present invention is shown in FIG. 5. In this case, the V-groove 31' is positioned peripherally about stem 27' just above the stem flange shoulder 29'. When an attempt is made to separate rotor 16 from base 14, the stem web 25' will tear along V-groove 31' and the rotor base assembly will thereafter be rendered useless for normal operation because stem 27 will be severed. An advantage of this design is that the tear occurs on stem 27', thereby obviating the need for the preventive bead 32.

Figure 6:
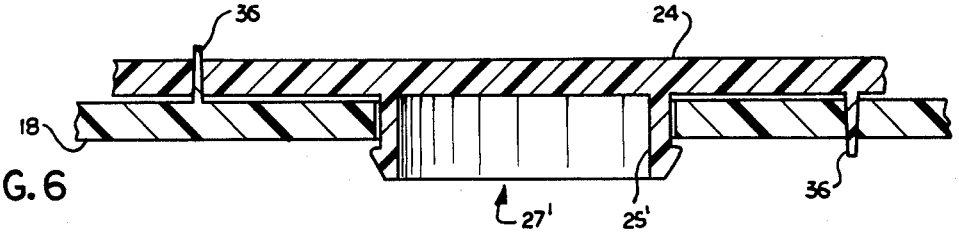
FIG. 6 is a cross-sectional view of a fourth embodiment of the present invention.

Another embodiment is shown in FIG. 6. One or more frangible pegs 36 are integrally formed with base web 18 and extend upwardly through rotor 16 and prevent rotation of rotor 16. Pegs 36 form a friction fit with web 24 so that pegs 36 cannot be pulled axially out of web 24 without breaking. When an attempt is made to separate rotor 16 from base 14, pegs 36 break and, although the rotor can be reinstalled on base 14, the rotor will be freely rotatable because pegs 36 are broken. Thus, the consumer is immediately aware of tampering because the rotor can be pivoted. Of course, pegs 36 may also be integrally formed in rotor 16 and extend downwardly into base web 24, as also shown at the right in FIG. 6.

It will be appreciated from the foregoing description that a new and improved tamperproof end closure for a container has been disclosed which utilizes the convenience of a rotary disc-type dispenser while providing an immediately perceivable indication, both visual and functional, that the container has been tampered with.

Although not shown in the drawing of the preferred embodiments, the frangible area 31 may be made in a serrated design, wherein a series of spaced serrations which extend all the way through the respective web thickness and about stem 27 cause the web to tear when an attempt is made to separate the base and rotor.

It is to be noted that when a pressure-type interference fit is used between stem 27 and the base 14 in lieu of a stem flange 28, the tear strength of the frangible area must be less than the retaining strength exerted by base web 18 on stem 27.

The frangible area of reduced web thickness may be formed on either the base web, rotor web, or stem web, and on either the upper or lower surface thereof. Furthermore, a designed-in redundancy may be provided by having more than one frangible area per end closure assembly. Thus, the base web, rotor web, and stem web, or any combination thereof, can be provided with a frangible area having a tear strength less than the retaining strength of stem 27 in opening 23.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a dispenser end closure having a base and a rotor pivotally connected to said base by a hub, said base and rotor having webs with means defining respective dispensing apertures therein, the rotor dispensing means being alignable with the base dispensing means by pivotal movement of said rotor with respect to said base about the axis of said hub, said hub slidably retaining said base and rotor in a close superposed relationship, the improvement comprising a frangible area on at least one of said base, rotor and hub elements, said frangible area being adapted to tear when an attempt is made to separate said base and rotor.

2. An end closure according to claim 1, wherein said frangible area is at least one groove having a reduced material thickness relative to the web thickness of said one element.

3. An end closure according to claim 1, wherein said frangible area is located about said hub and the strength of said frangible area is less than the retaining strength of the hub holding said base and rotor together.

4. An end closure according to claim 3, wherein said frangible area is on said rotor and at least a portion of said hub is retained on said base when said base and rotor are separated, thereby preventing said base and rotor from being pivotally connected together again by said hub.

5. An end closure according to claim 3, wherein said frangible area is on said hub and at least a portion of said hub is retained on said base web when said base and rotor are separated, thereby preventing said base and rotor from being pivotally connected together again by said hub.

6. An end closure according to claim 3, wherein said frangible area is on said base and at least a portion of the base web is retained on the hub when said base and rotor are separated, thereby preventing said rotor and hub from being pivotally connected together again by said hub.

7. An end closure according to claim 1, wherein said frangible area is one or more pegs extending between said base and rotor and initially preventing pivotal movement of said rotor and being adapted to break when said rotor and base are separated.

8. An end closure according to claim 3, wherein said frangible area is an annular groove of substantially reduced material thickness located generally concentrically about said hub.

9. An end closure according to claim 1, further comprising a bead on at least one of said base and rotor when said frangible area is on the other, said bead extending into said frangible area to prevent insertion of a substantially flat object between said base and rotor to pry the same apart without tearing said frangible area.

10. An end closure according to claim 1, wherein said rotor freely pivots about the axis of said hub while said frangible areas remain intact.

11. A tamper-resistant end closure for a container comprising a base and a rotor pivotally connected to said base, said base having a web portion with a first opening therein and means defining at least one dispensing aperture, said rotor having a web portion and a stem attached at one end to the rotor web, the free end of said stem extending through said first opening in the base web, said stem free end having retainer means for slidably engaging the base web portion along the periphery of said first opening and retaining said base and rotor in a close, superposed relationship, said rotor providing at least one opening in the rotor web substantially alignable with said means defining a dispensing aperture when said rotor is pivoted about the axis of said stem, and frangible means on at least one of said base, rotor and stem elements, said frangible means being adapted to break when an attempt is made to separate said base and rotor thereby preventing said base and rotor from being pivotally connected together again by said stem.

12. An end closure as set forth in claim 11, wherein said rotor freely pivots about the axis of said stem without breaking said frangible means.

13. An end closure as set forth in claim 11, wherein said frangible means is positioned about said stem and the strength of said frangible means is less than the strength of said retainer means holding said base and rotor together.

14. An end closure as set forth in claim 13, wherein said frangible means is a groove on at least one of the base web and rotor web, said groove having a reduced material thickness relative to the thickness of its respective web.

15. An end closure as set forth in claim 13, wherein said frangible means is on the rotor web such that at least a portion of said rotor web is retained on said stem when an attempt is made to separate said base and rotor.

16. An end closure as set forth in claim 13, wherein said frangible means is on the base web such that at least a portion of the base web is retained on said hub when an attempt is made to separate said base and rotor.

17. An end closure as set forth in claim 13, wherein said frangible means is on said stem such that at least a portion of said stem breaks away therefrom when an attempt is made to separate said base and rotor.

18. An end closure as set forth in claim 11, further comprising a bead on at least one of said base and rotor when said frangible means is on the other, said bead coacting with said frangible means to prevent insertion of an object intermediate said base and rotor so as to pry the same apart without breaking said frangible means.

* * * * *